United States Patent [19]

Hell et al.

[11] Patent Number: 4,770,631

[45] Date of Patent: Sep. 13, 1988

[54] APPARATUS AND BRICK MEMBER FOR SUPPORTING A CERAMIC TUBE DURING FIRING THEREOF

[75] Inventors: Hans-Jürgen Hell, Wiesbaden-Bierstadt; Horst Lindebauer, Wiesbaden; Jürgen Sommerer, Rauenthal, all of Fed. Rep. of Germany

[73] Assignee: Didier-Werke AG, Wiesbaden, Fed. Rep. of Germany

[21] Appl. No.: 68,185

[22] Filed: Jun. 30, 1987

[30] Foreign Application Priority Data

Jul. 25, 1986 [DE] Fed. Rep. of Germany ..... 3625115

[51] Int. Cl.[4] ..... F27D 5/00

[52] U.S. Cl. ..... 432/258; 432/249

[58] Field of Search ..... 432/253, 258, 260, 249; 266/279, 275

[56] References Cited

U.S. PATENT DOCUMENTS

| | | | |
|---|---|---|---|
| 2,803,447 | 8/1957 | King | 432/260 |
| 2,837,326 | 6/1958 | Muth | 432/249 |
| 2,871,543 | 2/1959 | Easter | 432/258 |
| 3,822,988 | 7/1974 | Booth | 432/258 X |
| 4,141,681 | 2/1979 | Lovatt | 432/258 |
| 4,184,840 | 1/1980 | Gamberg et al. | 432/258 X |
| 4,504,224 | 3/1985 | Hewitt | 432/258 |

*Primary Examiner*—Steven E. Warner

*Attorney, Agent, or Firm*—Wenderoth, Lind & Ponack

[57] ABSTRACT

An apparatus for supporting a ceramic tube during firing thereof includes a base on which is mounted a lower end of the ceramic tube and supports extending upwardly from the base. A brick member is supported on the supports for grasping an upper end of the ceramic tube and for, during axial contraction of the tube during firing thereof, suspending the tube and allowing withdrawal of the lower end of the tube from the base while ensuring vertical alignment of the thus suspended tube. The brick has therethrough an opening for surrounding the upper end of the tube and defining a balancing space between the brick and the tube. Mortar fills the balancing space.

16 Claims, 2 Drawing Sheets

APPARATUS AND BRICK MEMBER FOR SUPPORTING A CERAMIC TUBE DURING FIRING THEREOF

BACKGROUND OF THE INVENTION

The present invention relates to an apparatus and a brick member for supporting a ceramic tube during firing thereof. Particularly, the present invention is directed to such an apparatus and brick member for supporting and suspending the tube by its upper end during the time the tube is fired.

Ceramic tubes cannot be fired while standing or lying on their side in a furnace, for example an electric furnace, because the ceramic tubes thereby would be distorted. Such ceramic tubes therefore conventionally are fired while suspended.

A known supporting or suspension apparatus requires that the ceramic tubes be formed to an excessive length, i.e. a length greater than required. The excess or surplus portion of the tube is provided with holes through which extends a ceramic rod. Such rod is positioned in the apparatus with the tubes suspended therefrom and such that the tube can swing about the axis of such ceramic rod. The holes through the ceramic tube therefore must be formed exactly perpendicularly to the longitudinal axis of the ceramic tube, since otherwise the tube would hang from the ceramic rod in a direction with the tube axis slanted or inclined to the vertical, and this also would lead to distortion of the tube. Additionally, it is not unusual for the ceramic tube to break at the areas of the holes or for the ceramic rod to snap. This is ultimately due to the basic nature of this support arrangement wherein the holes provide relatively small bearing areas. Additionally, in this type of support arrangement after firing of the ceramic tubes it is necessary that the excess tube length be removed.

SUMMARY OF THE INVENTION

Accordingly, it is an object of the present invention to provide an improved apparatus for supporting a ceramic tube during firing thereof, whereby the above and other prior art disadvantages are overcome.

It is a more particular object of the present invention to provide such an apparatus whereby the ceramic tube accurately is supported precisely vertically during firing, without the need for providing the ceramic tube with an extra length portion.

It is a further object of the present invention to provide a brick member for use in such a support apparatus.

In accordance with the present invention, the above and other objects are achieved by the provision of a support apparatus including a base on which is mounted a lower end of a ceramic tube to be fired, support means extending upwardly from the base, and means, supported on the support means, for grasping an upper end of the ceramic tube to be fired and for, during axial contraction of the tube which occurs during firing thereof, suspending the tube and allowing withdrawal of the lower end of the tube away from the base while ensuring vertical alignment of the thus suspended tube. In particular accordance with the present invention, this grasping means is in the form of a brick or brick member having therethrough an opening for surrounding the upper end of the tube and defining a balancing or equalizing space between the brick and the tube with mortar filling such space. The lower end of the tube is directly or indirectly supported on the base. When loading the apparatus, the ceramic tube to be fired is placed between supports of the support means. The brick member grasps around the tube at the upper end thereof. The mortar is filled into the balancing or equalizing space but has not yet hardened.

At the start of the firing operation, the ceramic tube contracts and the mortar hardens gradually. As a result of the contraction, the lower end of the ceramic tube becomes detached from the base, i.e. withdraws upwardly therefrom, so that thereafter the ceramic tube hangs or is suspended from the brick member by means of the mortar. Under the action of the weight of the ceramic tube, the tube will assume a precise vertical position until the mortar hardens. After the mortar has hardened, the tube is held securely in such vertical position.

This apparatus has the advantage that the ceramic tube does not have to be made with an excess or surplus length portion provided with holes and that must be cut off or otherwise removed after the firing operation. The ceramic tube is held in the apparatus of the present invention in a nondestructive manner. Further, the present invention has the dvantage that, until the mortar hardens, the tube is allowed to swing to a vertical position in all possible planes. Additionally, since the ceramic tube is held around its entire periphery, breaking off or snapping in the area of attachment is avoided.

In a particularly preferred embodiment of the present invention, the brick or brick member is outwardly flared from a narrowest point which matches the exterior size of the upper end of the tube. Specifically, the opening through the brick member is conically tapered or flared outwardly and upwardly from the narrowest point or diameter of the opening, and such narrowest point or opening matches or equals the outer diameter of the upper end of the tube. This promotes the ability of the tube to swing in any plane to a precisely vertical position, and also promotes a firm grasping of the tube even before the mortar hardens. These advantages particularly are due to the very narrow grasping zone provided by the brick member and to the space above such grasping zone which enables movement of the tube end above the grasping zone to achieve an accurately vertical alignment.

The brick member of the present invention preferably is formed of plural brick portions in order to simplify the installation and removal of the brick member. The brick segments or portions can be pushed toward the tube in a direction radial to the longitudinal axis thereof. After firing, the tube segments or portions easily can be removed without damaging the tube. Thus, the brick member is divided through the opening to form the plural brick segments or portions, and preferably such division is achieved substantially radially of the opening.

BRIEF DESCRIPTION OF THE DRAWINGS

Other objects, features and advantages of the present invention will become apparent from the following description of a preferred embodiment, with reference to the accompanying drawings, wherein.

DETAILED DESCRIPTION OF THE INVENTION

Figure 1:
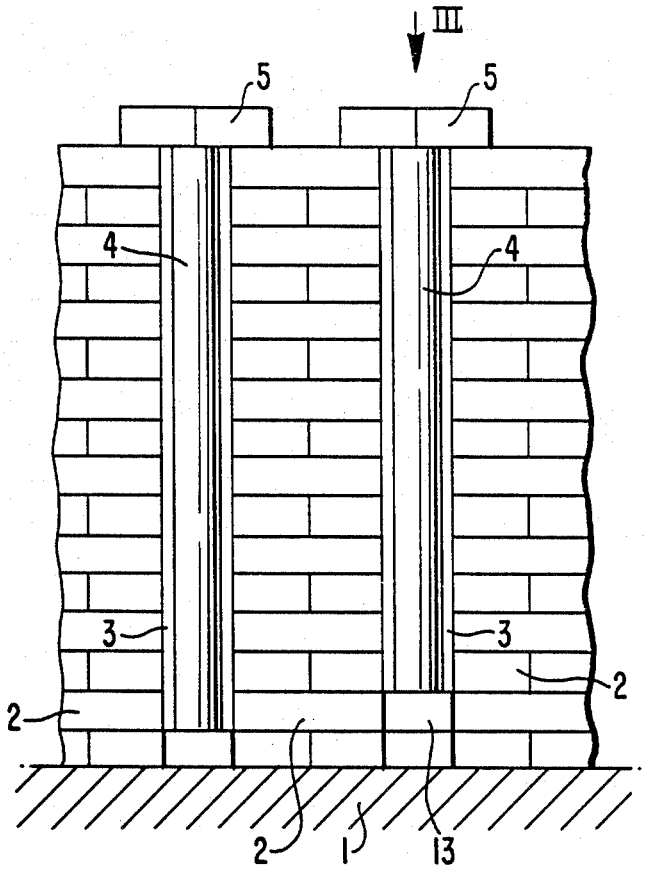
FIG. 1 is an elevational view of a preferred embodiment of the apparatus of the present invention.
Figure 2:
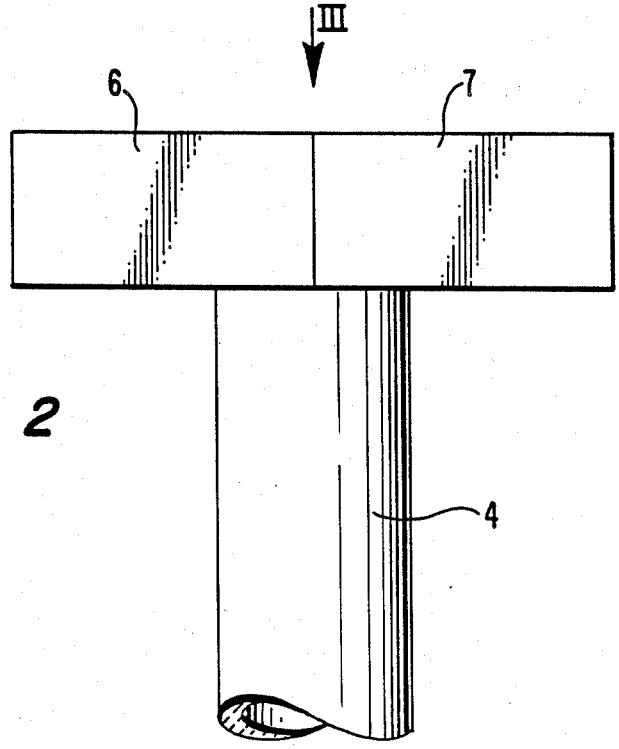
FIG. 2 is an enlarged elevational view of the upper end of one ceramic tube and a brick member installed to grasp such upper end.

A base 1 has extending upwardly therefrom a plurality of supports 2 defining therebetween ducts 1. ducts 3 are unfired ceramic tubes 4 which are to be fired. The lower ends of tubes 4 are supported directly on base 3 or alternatively on supporting bodies 13.

Figure 3:
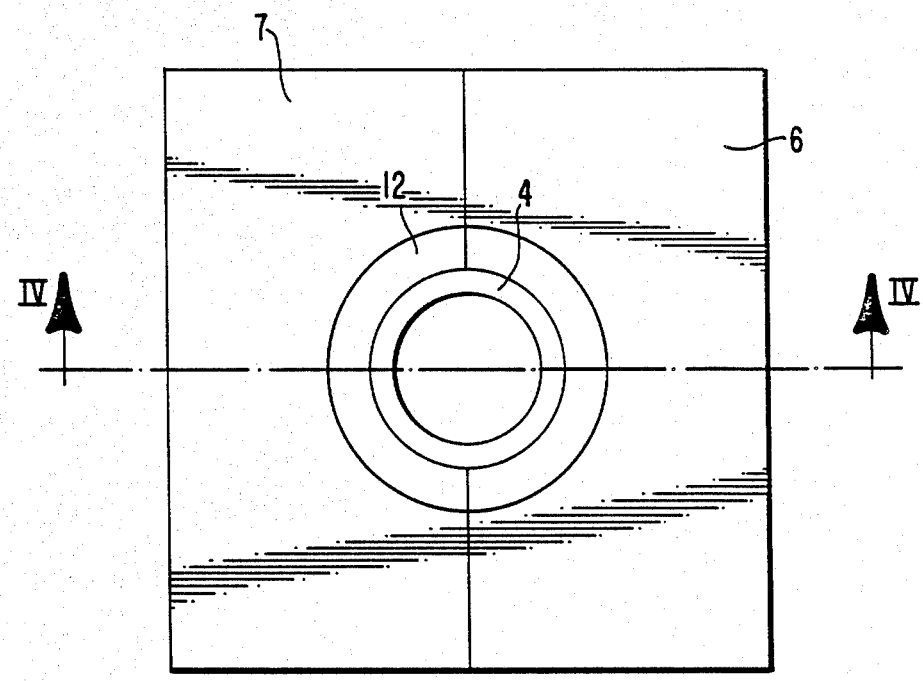
FIG. 3 is a plan view, taken in the direction of arrow III in FIG. 2, of the apparatus therein.
Figure 4:
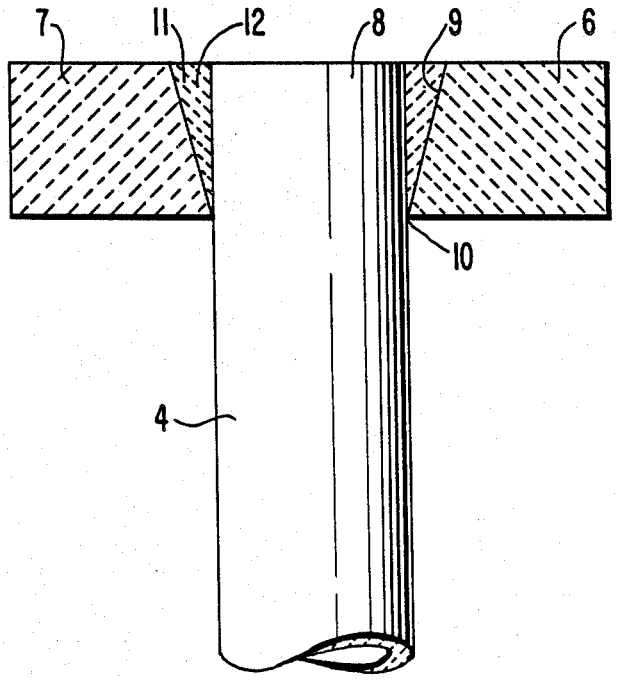
FIG. 4 is a cross sectional view taken along line IV—IV of FIG. 3.

In accordance with the present invention, each tube 4 is supported at the upper end by a brick member 5. Specifically, brick member 5 is supported on supports 2 and is in the form of, as shown in FIG. 3, two half-brick segments or portions 6, 7. The segments 6, 7 together define an opening 9 extending through the brick member. Thus, the segments 6, 7 are supported on supports 2 and then are pushed together with the upper end 8 of tube 4 therebetween. When the segments 6, 7 are pushed together to form the brick member 5, then the upper end 8 of the tube will extend through the opening 9. The brick member thus grasps the upper end of the tube at a narrowest portion or point 10 of opening 9 which is matched or equal to the outer size of the upper end 8 of the tube. From narrowest point 10, opening 9 flares conically outwardly and upwardly to define a balancing or equalizing space 11 between tube 4 and segments 6, 7. This space serves as an equalizing joint enabling pivoting in any direction of the upper end of the tube above clamping zone 10. Space 11 is filled with mortar 12.

As shown in FIG. 1, the tubes 4 may be formed of unequal lengths, and consequently the shorter tubes rest on higher supporting bodies 13 than do the longer tubes. As shown in FIG. 3, the brick member is divided into segments 6, 7 radially of opening 9 and of tube 4.

After the tubes have been arranged in the above described manner, then firing is initiated in a known manner, at which time the tubes contract axially. Because the tubes are held at their tops by segments 6, 7 or by mortar 12, the longitudinal contraction will result in tubes 4 withdrawing upwardly from supporting bodies 13. The thus suspended tubes will assume, due to their own weight, exactly vertical positions. The still incompletely hardened mortar 12 in space 11 allows a corresponding movement of the upper end 8 of tube 4 above grasping zone 10.

After the firing operation is completed, segments 6, 7 and mortar 12 easily can be removed from tube 4, and brick segments or portions 6, 7 again can be used for further firing operations.

Although the present invention has been described and illustrated with respect to preferred features, it is to be understood that various changes and modifications may be made to the specifically described and illustrated features without departing from the scope of the present invention.

We claim:

1. An apparatus for supporting a ceramic tube during firing thereof, said apparatus comprising:

a base on which is mounted a lower end of a ceramic tube to be fired;

support means extending upwardly from said base; and means, supported on said support means, for grasping an upper end of the ceramic tube to be fired and for, during axial contraction of the tube during firing thereof, suspending the tube and allowing withdrawal of the lower end of the tube from said base while ensuring vertical alignment of the thus suspended tube, said grasping means comprising a brick having therethrough an opening for surrounding the upper end of the tube and defining a balancing space between said brick and the tube, and mortar filling said space.

2. An apparatus as claimed in claim 1, wherein said opening is outwardly flared from a narrowest point matching the exterior size of the upper end of the tube.

3. An apparatus as claimed in claim 2, wherein said opening is flared upwardly from said narrowest point.

4. An apparatus as claimed in claim 3, wherein said opening is flared conically.

5. An apparatus as claimed in claim 3, wherein said space is located above said narrowest point.

6. An apparatus as claimed in claim 1, wherein said brick is formed of plural brick portions.

7. An apparatus as claimed in claim 6, wherein said brick is divided through said opening to form said plural brick portions.

8. An apparatus as claimed in claim 7, wherein said brick is divided substantially radially of said opening to form said plural brick portions.

9. A brick member for use in an apparatus for supporting a ceramic tube during firing thereof and wherein a lower end of the ceramic tube is mounted on a base having extending upwardly therefrom support means for supporting the brick member, said brick member comprising:

an opening extending entirely through said brick for surrounding an upper end of the tube and for defining a balancing space between said brick and the tube, whereby mortar may be filled into said opening, and whereby said brick member and mortar grasp the upper end of the ceramic tube and, during axial contraction of the tube during firing thereof, suspend the tube and allow withdrawal of the lower end of the tube from the base while ensuring vertical alignment of the thus suspended tube.

10. A brick member as claimed in claim 9, wherein said opening is outwardly flared from a narrowest point matching the exterior size of the upper end of the tube.

11. A brick member as claimed in claim 10, wherein said opening is flared upwardly from said narrowest point.

12. A brick member as claimed in claim 11, wherein said opening is flared conically.

13. A brick member as claimed in claim 11, wherein said space is located above said narrowest point.

14. A brick member as claimed in claim 9, formed of plural brick portions.

15. A brick member as claimed in claim 14, divided through said opening to form said plural brick portions.

16. A brick member as claimed in claim 15, divided substantially radially of said opening to form said plural brick portions.

* * * * *